US005348356A

United States Patent [19]

Moulton

[11] Patent Number: 5,348,356

[45] Date of Patent: Sep. 20, 1994

[54] HIDDEN, RELEASABLE LATCH FOR A MOLDED PLASTIC ENCLOSURE

[75] Inventor: James I. Moulton, Sunnyvale, Calif.

[73] Assignee: Apple Computer, Inc., Cupertino, Calif.

[21] Appl. No.: 42,301

[22] Filed: Apr. 2, 1993

[51] Int. Cl.[5] ..... E05C 19/06

[52] U.S. Cl. ..... 292/80; 292/87; 292/91; 292/DIG. 38

[58] Field of Search ..... 292/80, 87, 91, 83, 292/10, DIG. 38; 24/614, 615

[56] References Cited

U.S. PATENT DOCUMENTS

| | | | |
|---|---|---|---|
| 195,117 | 9/1877 | Frankel | 292/83 |
| 292,967 | 2/1884 | Wayland | 292/83 |
| 317,736 | 5/1885 | Cowell | 292/83 |
| 832,284 | 10/1906 | White | 292/83 |
| 1,941,165 | 12/1933 | Earl | 292/91 |
| 2,461,330 | 2/1949 | Landwehr | 292/83 X |
| 3,305,432 | 12/1942 | Kupfermann et al. | 292/87 |
| 4,323,807 | 4/1982 | Sugiura | 292/DIG. 38 X |
| 4,344,646 | 8/1982 | Michel | 292/DIG. 38 X |
| 4,673,100 | 6/1987 | Reis et al. | 292/87 X |
| 4,730,731 | 3/1988 | Allison | 292/DIG. 38 X |

*Primary Examiner*—Lloyd A. Gall
*Attorney, Agent, or Firm*—Mark Aaker

[57] ABSTRACT

A hidden, releasable latch for a molded plastic enclosure having a first panel abutting a second panel along a seam. The first panel has a pressure bump on its inside surface a first distance from the seam, and a projecting tang on its inside surface at a further distance from the seam. The second panel has a tab from its inside surface projecting inside, parallel and spaced from the inside surface of the first panel, the tab contacting the pressure bump, and capturing the projecting tang in a hole within the tab. The tab is flexible enough for slight deflection during the capturing of the tang by the hole during an assembly process, and the releasing of the tang by movement of the tab from pressure from the pressure bump during a disassembly process.

13 Claims, 5 Drawing Sheets

HIDDEN, RELEASABLE LATCH FOR A MOLDED PLASTIC ENCLOSURE

BACKGROUND OF THE INVENTION

This invention relates to a mechanical latch or fastener for joining the pieces of a plastic enclosure. For example, a plastic front panel or bezel can be secured to a plastic main panel or chassis using the latch of this invention. In particular, the pieces of this latch can be directly molded onto the panels and can be formed of the same materials as the panels.

Molded plastic enclosures are used to house electronic circuitry, such as computers, disk drives and video monitors. To reduce the cost of these enclosures, it is desirable that separate panels of the enclosure can be joined by simple latching or catch mechanisms, preferably molded directly into the plastic material. This eliminates additional separate screws, rivets, clamps or other fasteners. This invention provides a latching mechanism which can be molded directly into the enclosure material.

To improve the appearance of molded plastic enclosures, it is desirable that the outside surface of the assembled enclosure have a smooth, flush, finished appearance without screw heads or rivet heads, visible fasteners, or holes. This invention provides a "hidden" latch mechanism, which is not visible after the pieces of the enclosure are joined.

To be able to access the contents of a molded plastic enclosure, it is desirable that the enclosure can be easily disassembled and unlatched or opened for access to the internal components. This requires latches or fasteners that can be released or deactivated during disassembly, and then re-latched during a re-assembly process. This invention provides a releasable latch which can be easily unlatched for disassembly, and relatched for reassembly.

Conventional molded plastic latch designs have several disadvantages. FIG. 1 shows a schematic cut-away side view of a conventional approach to a hidden, releasable, molded latch for joining two panels of an enclosure. First panel 10 has a projecting hook or projecting tang 12 molded on its inside surface near an edge. Second panel 20 has a hole 22 formed near a corresponding edge. When the enclosure is assembled by sliding panel 20 into panel 10, the projecting tang 12 can be captured in hole 22, thereby holding the panels from sliding back out of the assembled position. Of course, additional molded edges, guides and stops can be used to more precisely position and align the panels, but the basic restraining force holding the panels is provided by the capture of the tang 12 in hole 22. Note, that this conventional design requires that panel 20 be "within" or "nest inside" of panel 10 in order to properly operate and to hide the latch. Therefore, the seam between the panels will be a "step" or "offset" 32 rather titan a smooth, flush edge-on-edge abutment of the panels. To release this latch, an external force 30 is applied to panel 20 at a spot below the seam or offset 32. This force will deflect panel 20 inward, until the tang 12 is released from hole 22, and the panels can be slid apart.

FIG. 2 shows a schematic cut-away side view of a conventional approach to a flush-surface, hidden, releasable, molded latch for joining two panels of an enclosure. FIG. 2 is similar to FIG. 1, with similar parts numbered correspondingly. Again, first panel 10 has a projecting tang 12 molded onto its inside surface. Second panel 20 has an edge formed with a projecting latch tab 24. Tab 24 extends inside and parallel to first panel 10. Tab 24 has a hole 22 molded in it. The edge of panel 20 provides a recess into which the edge of panel 10 will rest, in order to provide a "flush" seam, rather than a seam with an offset 32 of FIG. 1. When the enclosure is formed by sliding panel 20 against panel 10, tab 24 slides within panel 10, and the projecting tang 12 can be captured in hole 22, thereby holding the panels together. Note, that this design requires that the tab 24 which has hole 22 is contained "within" or "inside" of panel 10 in order to operate and to hide the latch. However, the seam between the panels will be flush rather than offset. In order to release this latch, a means to deflect tab 24 away from tang 12 must be provided. Conventionally, this is done by providing a hole 34 in the first panel 10 at a location opposite the end of tab 24. If a tool 36 is placed in the hole 34, then an external force 30 can be applied to tab 24 to deflect it and release tang 12 from hole 22. Overall, in this conventional design of FIG. 2, the desired flush surface has been achieved at the tradeoff of a hole 34 for use in releasing the latch.

From these examples of conventional approaches it can be seen that what is desired is a hidden, releasable, molded latch which allows flush surfaces and no external holes.

SUMMARY OF THE INVENTION

This invention provides a hidden, releasable latch for a molded plastic enclosure. An enclosure using this invention has a first panel abutting a second panel along a seam. The first panel has a pressure pad or pressure bump on its inside surface a first distance from the seam, and a projecting hook or projecting tang on its inside surface at a further distance from the seam. The second panel has a tab extending from its inside surface and projecting inside, parallel and spaced from the inside surface of the first panel. The tab contacts or rests on the pressure bump, and the tab has a hole for capturing the projecting tang. The tab is flexible enough for slight deflection during the capturing of the tang by the hole during an assembly process, and for the releasing of the tang by movement of the tab away from the tang by pressure from the pressure bump during a disassembly process.

DETAILED DESCRIPTION

Figure 1:
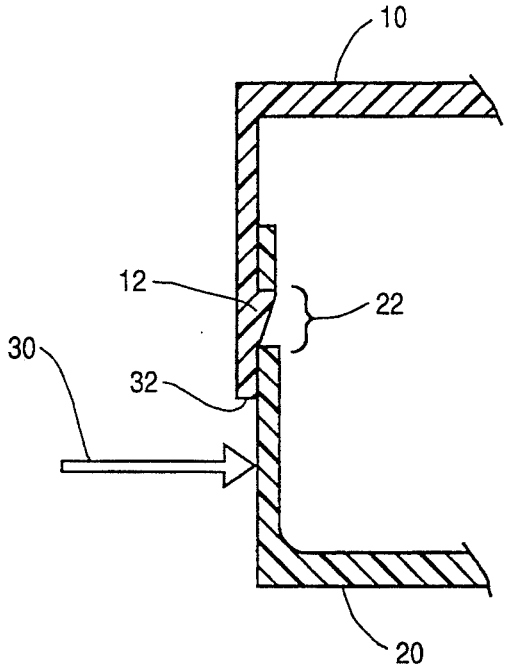
FIG 1 (PRIOR ART)
FIG. 1 shows a schematic cut-away side view of a conventional approach to a hidden, releasable, molded latch for joining two panels of an enclosure.
Figure 2:
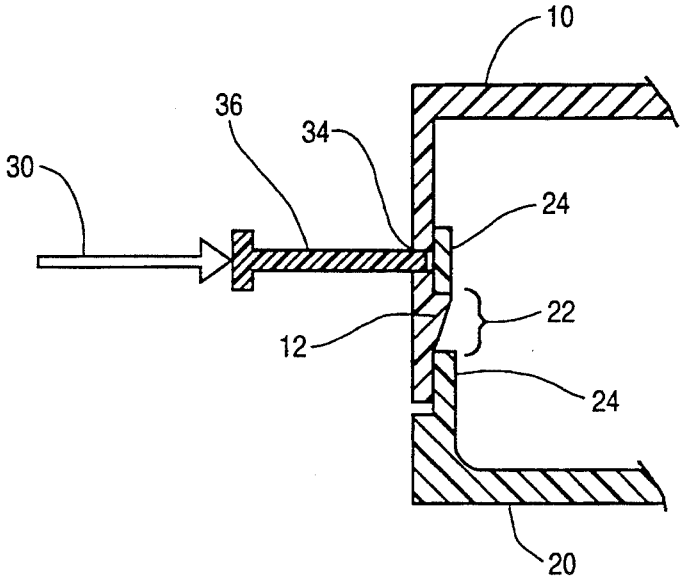
FIG 2 (PRIOR ART)
FIG. 2 shows a schematic cut-away side view of a conventional approach to a flush-surface, hidden, releasable, molded latch for joining two panels of an enclosure.
Figure 3:
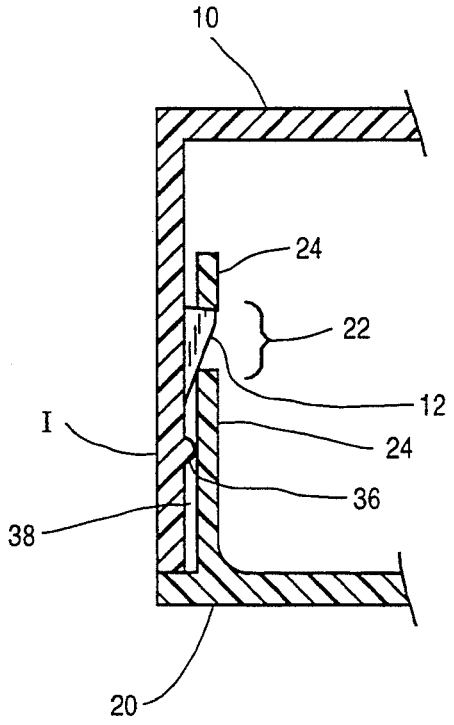
FIG. 3 shows a schematic cut-away side view of a hidden, releasable, molded latch in accordance with this invention.

FIG. 3 shows a schematic cut-away side view of a hidden, releasable, molded latch in accordance with this invention. Molded plastic enclosure pieces 10 and 20 are joined by latching a projecting molded plastic tang 12 on panel 10 into a hole 22 on a molded plastic tab 24 extending from panel 20. The panels are assembled with a flush fit, that is, no offset 32 of FIG. 1 is required. Instead, the tab 24 is spaced inward from the first panel 10 by a small distance or gap 38. This gap 38 is formed by roofing the tab 24 at a set-back distance on panel 20, and by placing a small pressure bump 36 between the tab 24 and inside surface of the first panel 10. The pressure bump 36 sits approximately halfway between the seam and the tang 12. The pressure bump 36 can be formed on either the tab 24 or on the panel 10. The gap is also maintained by the contact of the tang 12 and hole 22, which can be designed to keep tab 24 a small distance from the inside of panel 10, even when the tang 12 and hole 22 are engaged.

The enclosure is formed by sliding panel 20 against panel 10, with tab 24 sliding within panel 10, so that hole 22 captures the projecting tang 12, thereby holding the panels together. Tab 24 will deflect slightly as it travels over the pressure bump 36 and projecting tang 12.

Figure 4:
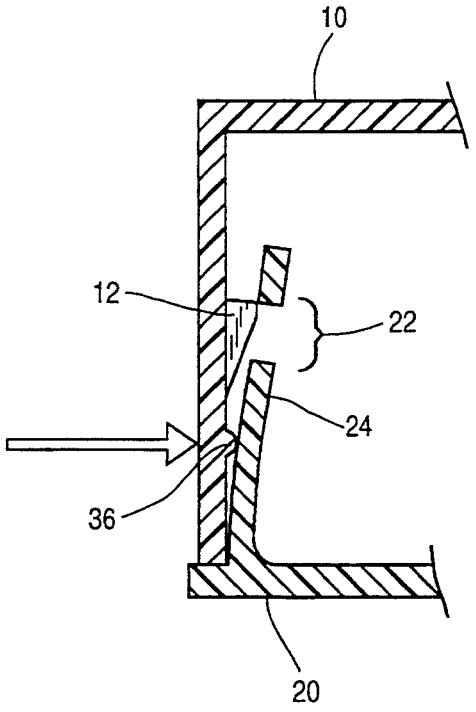
FIG. 4 shows a schematic cut-away side view of how to release a latch in accordance with this invention.

FIG. 4 shows a schematic cut-away side view of how to release a latch in accordance with this invention. In order to release this latch, tab 24 must be deflected away from tang 12 until the tang 12 is released from hole 22, and the panels can be slid apart. In this design, the external force 30 is applied to the outside of panel 10 opposite the location of the pressure bump 36. If desired, this location can be marked by an indicator on the outside of panel 10. This applied force deflects panel 10 inward so that pressure bump 36 also causes tab 24 to deflect inward, thereby raising hole 22 off tang 12 and releasing the latch. The panels can then be slid apart. The small gap 38 between the panel 10 and the tab 24 provides a space into which the edge of panel 10 can deflect when the external force is applied. The width of the gap 38, which approximately corresponds to the set-back of tab 24 on panel 20, also limits the total possible deflection of panel 10 so that the panel cannot be over-deflected or over-stressed and damaged. The deflection of the first panel 10 is transferred via the pressure bump 36 to the deflection of the tab 24. Clearly, the spacing of the tang, bump, seam, gap and tab are interrelated for proper operation during the release operation. The deflection of the first panel 10 at an indicator I provides the movement of the pressure pad 36, which acts somewhat as a fulcrum to deflect the tab 24. It has been found that placing the pressure bump 36 approximately halfway between the tang 12 and seam is suitable for the standard plastic enclosure materials and their thickness and flexibility. Preferably the latch elements are molded from the same materials as the enclosure panels, such as ABS, although they can be separately formed. For example, the tab could be formed of a flexible spring metal.

Figure 5:
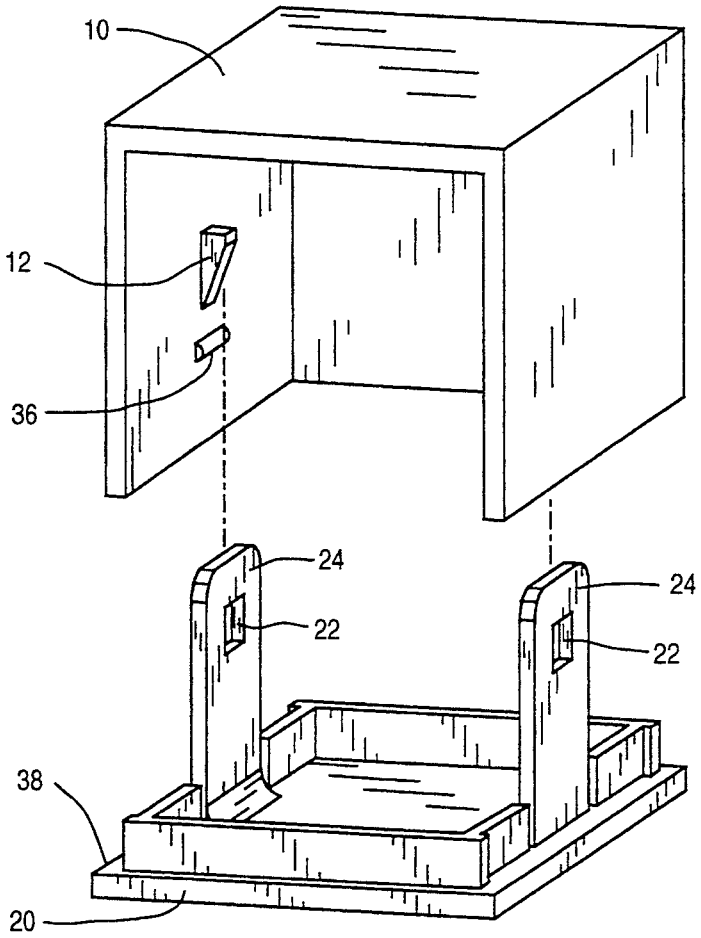
FIG. 5 shows a perspective view of a disassembled enclosure having latches in accordance with this invention.

FIG. 5 shows a perspective view of a disassembled enclosure having latches in accordance with this invention. On the inside of first panel 10 can be seen the projecting tang 12 and the pressure bump 36. On the inside of second panel 20 can be seen two tabs 24, each with a hole 22 near its end. Gap 38 provides the space into which panel 10 sits and then deflects during a release operation.

Figure 6:
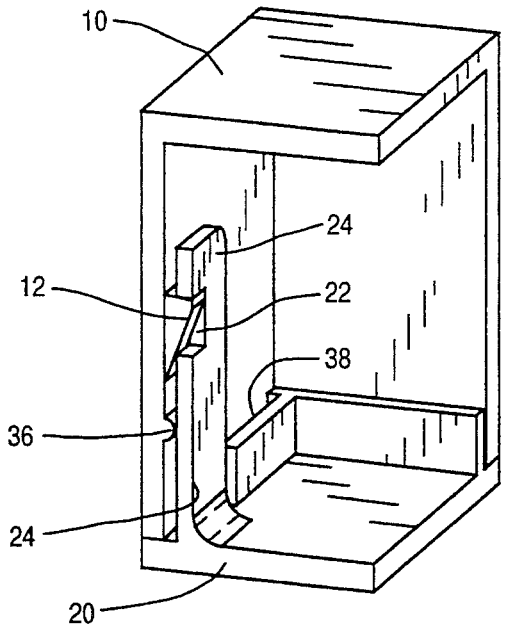
FIG. 6 shows a cut-away perspective view of an assembled latch and enclosure corresponding to the latches and enclosure as shown in FIG. 5.

FIG. 6 shows a cut-away perspective view of an assembled latch and enclosure corresponding to the latches and enclosure as shown in FIG. 5. In particular, it should be noted how tang 12 is captured in hole 22, and how tab 24 rests on pressure pad 36. Gap 38 is somewhat filled by panel 10, but has remaining space into which panel 10 deflects during a release operation.

Figure 7:
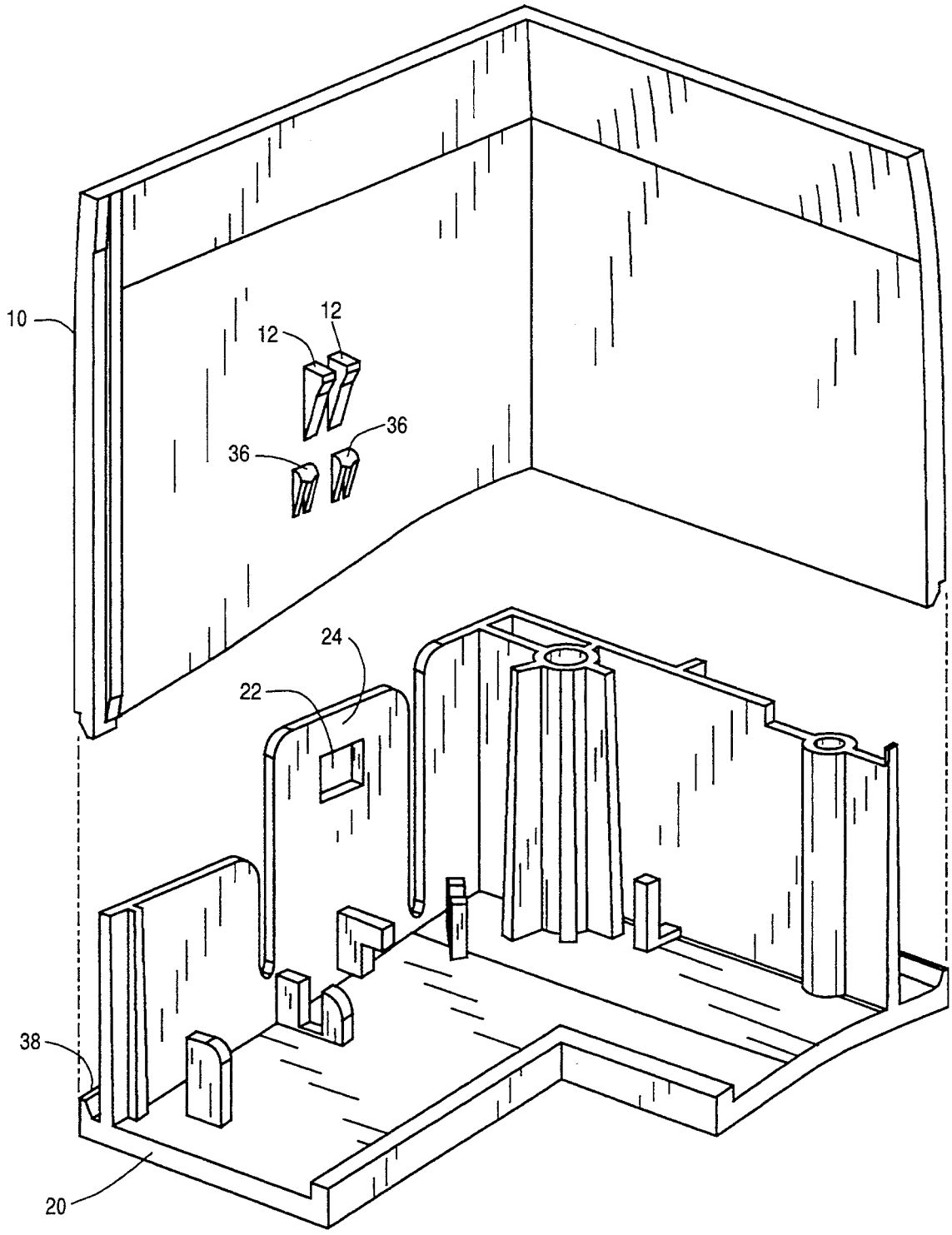
FIG. 7 shows a perspective view of a disassembled enclosure having another embodiment of a latch in accordance with this invention.
Figure 8:
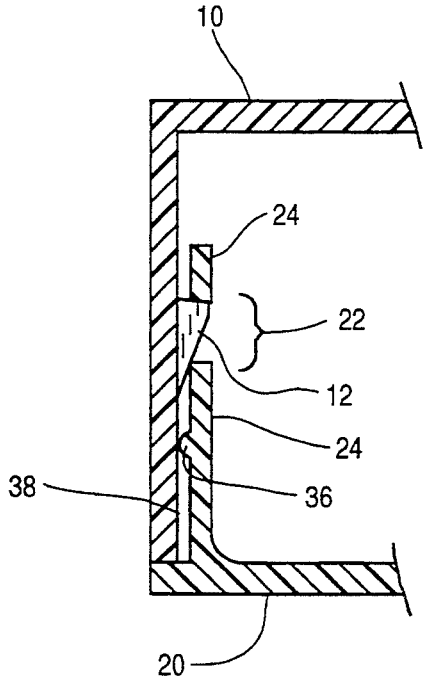
FIG. 8 shows a pressure bump on the second panel.
Figure 9:
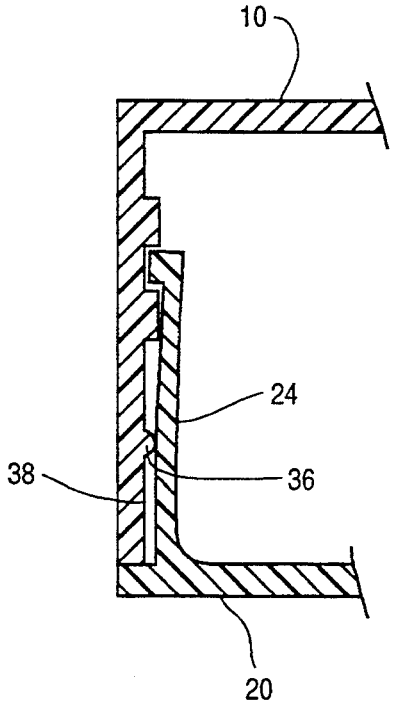
FIG. 9 shows the projecting mesa embodiment.

FIG. 7 shows a perspective view of a disassembled enclosure having another embodiment of a latch in accordance with this invention. On the inside of first panel 10 can be seen multiple projecting tangs 12 and pressure bumps 36. On the inside of second panel 20 can be seen a tab 24, with a hole 22 near its end. Note that tab 24 is spaced back from the edge of panel 20 so that there is a gap 38 in which panel 10 can sit and then into which it can further deflect during a release operation.

In other alternatives, the pressure bump can be formed on the tab 24 rather than on panel 10. The tang 12 or tab 24 can be separate pieces attached to their respective panels rather than formed simultaneously with them. The tang can have other suitable shapes such as a hook, pin, slide, or blade. The hole can also be a recess, or partially formed hole sufficient to capture the tang. The hole could also be a matching hook, ridge, or edge for capturing the tang. The panels holding the tang and hole can be reversed. For example, panel 10 instead of a hook can have a raised mesa with a hole or recess in its inward face or end. Panel 20 would then have a hook or tang to be captured in this recess.

Other methods for implementing this invention would use other tang and hole designs. However, the same inventive features of a tab and pressure bump would be used to allow a hidden, releasable latch in accordance with this invention. Other embodiments and variations of the invention will be apparent to one skilled in the art from a consideration of the specification drawings, and claims. It is intended that the scope of the invention be limited only by the scope of the following claims.

I claim:

1. A hidden, releasable latch for a molded plastic enclosure comprising:

a first panel abutting a second panel along a seam;

said first panel having a pressure bump on an inside surface a first distance from the seam, and a projecting tang on the inside surface at a further distance from the seam;

said second panel having a tab on an inside surface projecting inside, parallel and spaced from said inside surface of said first panel, said tab contacting said pressure bump, and capturing said tang in a hole within said tab; and said tab being flexible for deflection movement during the capturing of said tang during an assembly process, and the releasing of said tang by pressure from said pressure bump during a disassembly process.

2. A hidden, releasable latch as in claim 1 wherein said first panel can deflect inward from pressure on an outside surface opposite said pressure bump.

3. A hidden, releasable latch as in claim 2 further comprising an indication on the outside surface of said first panel opposite said pressure bump.

4. A hidden, releasable latch as in claim 1 wherein said pressure bump is located approximately one-half the distance from the tang to the seam.

5. A hidden, releasable latch as in claim 1 wherein said panels, tang, pressure bump, and tab are all formed of molded plastic material.

6. A hidden, releasable latch for a molded plastic enclosure comprising:

a first enclosure panel abutting a second enclosure panel along a seam, each panel having an inside surface facing within said enclosure and an outside surface facing to the outside of said enclosure; said first panel having a projecting tang on the inside surface at a first distance from the seam;

said second panel having a tab on the inside surface extending inside, parallel and spaced a gap distance from said inside surface of said first panel, said tab spaced from said inside surface of said first panel by a pressure bump located between said tab and said inside surface of said first panel, said pressure bump being located approximately halfway between said tang and said seam, said tab running beyond said projecting tang at said first distance, so that a hole within said tab removably captures said tang, said tab being flexible for deflection movement during the capturing of said tang during assembly, and the releasing of said tang by pressure from said pressure bump during disassembly.

7. A hidden, releasable latch as in claim 6 wherein said pressure bump is formed as a projection on the inside surface of said first panel.

8. A hidden, releasable latch as in claim 6 wherein said pressure bump is formed as a projection on said tab on the side facing the inside surface of said first panel.

9. A hidden, releasable latch as in claim 6 wherein said first panel can deflect inward from pressure on the outside surface opposite said pressure bump.

10. A hidden, releasable latch as in claim 6 further comprising an indication on outside surface of said first panel opposite said pressure bump.

11. A hidden, releasable latch as in claim 6 wherein said hole in said tab is a recess adapted for capturing said tang as said panels are slid into abutment.

12. A hidden, releasable latch as in claim 6 wherein said panels, tang, pressure bump, and tab are all formed of molded plastic material.

13. A hidden, releasable latch for a molded plastic enclosure comprising:

a first enclosure panel movably abutting a second enclosure panel along a seam, each panel having an inside surface facing within said enclosure and an outside surface facing to the outside of said enclosure;

said first panel having a projecting mesa on the inside surface at a first distance from the seam, said mesa having a central recess, said first panel also having a pressure bump on the inside surface between the mesa and seam, said pressure bump substantially the same height as said mesa;

said second panel having a tab on the inside surface extending inside, parallel and spaced a gap distance from said inside surface of said first panel by said pressure bump and said mesa, said tab running to a projecting tang to be removably captured within said central recess of said mesa, said tab being flexible for deflection movement during the capturing of said tang during assembly, and the releasing of said tang by pressure from said pressure bump during disassembly.

* * * * *